US012630933B2

(12) United States Patent
Li et al.

(10) Patent No.: US 12,630,933 B2
(45) Date of Patent: May 19, 2026

(54) METHOD FOR ELECTROCHEMICAL PREPARATION OF POLYTHIOCTIC ACID AND DERIVATIVE THEREOF

(71) Applicant: Jilin University, Jilin Province (CN)

(72) Inventors: Wen Li, Jilin Province (CN); Jun Fang, Jilin Province (CN)

(73) Assignee: Jilin University, Changchun City (CN)

( * ) Notice: Subject to any disclaimer, the term of this patent is extended or adjusted under 35 U.S.C. 154(b) by 93 days.

(21) Appl. No.: 18/640,638

(22) Filed: Apr. 19, 2024

(65) Prior Publication Data

US 2025/0179662 A1 Jun. 5, 2025

(30) Foreign Application Priority Data

Dec. 4, 2023 (CN) ..... 202311638951.7

(51) Int. Cl.
*C25B 3/23* (2021.01)
*C25B 7/00* (2006.01)
*C25B 11/046* (2021.01)

(52) U.S. Cl.
CPC ..... *C25B 7/00* (2013.01); *C25B 11/046* (2021.01)

(58) Field of Classification Search
CPC ..... C25B 3/23
USPC ..... 205/419
See application file for complete search history.

(56) References Cited

FOREIGN PATENT DOCUMENTS

CN 116169358 A * 5/2023 ..... H01M 10/052

OTHER PUBLICATIONS

Krishnan et al., "Electrochemical Behavior of the Super Antioxidant, α-Lipoic Acid," International Journal of Electrochemical Science (Aug. 1, 2011), vol. 6, No. 8, pp. 3607-3630. (Year: 2011).*

* cited by examiner

*Primary Examiner* — Edna Wong
(74) *Attorney, Agent, or Firm* — Bryan D. Zerhusen, Esq.; Nicholas R. Herrel, Esq.; CANTOR COLBURN LLP

(57) ABSTRACT

Provided is a method for electrochemical preparation of polythioctic acid (PTA) and a derivative thereof. The method includes: mixing a thioctic acid (TA) monomer, a supporting electrolyte, and a polar solvent to obtain a mixed liquor; and subjecting the mixed liquor to electrochemical polymerization to obtain the PTA and/or the derivative thereof on a surface of an anode, wherein the TA monomer comprises one or more selected from the group consisting of TA and a TA derivative, and the TA derivative has a structure shown in formula I, wherein R is a derived group.

formula I

7 Claims, 7 Drawing Sheets

METHOD FOR ELECTROCHEMICAL PREPARATION OF POLYTHIOCTIC ACID AND DERIVATIVE THEREOF

CROSS REFERENCE TO RELATED APPLICATION

This patent application claims the benefit and priority of Chinese Patent Application No. 202311638951.7 filed with the China National Intellectual Property Administration on Dec. 4, 2023, and entitled with "METHOD FOR ELECTROCHEMICAL PREPARATION OF POLYTHIOCTIC ACID AND DERIVATIVE THEREOF", the disclosure of which is incorporated by reference herein in its entirety as part of the present application.

TECHNICAL FIELD

The present disclosure relates to the technical field of electrochemical synthesis, and in particular to a method for electrochemical preparation of polythioctic acid (PTA) and a derivative thereof.

BACKGROUND

Polymer materials have characteristics such as low specific density, high strength, and stable chemical properties, and are widely used in many fields such as national defense, aerospace, and electronics industry. Polymer materials have become an indispensable part of the production and life of humans. However, polymer materials easily cause white pollution due to their non-degradability. In order to realize the strategic task of sustainable development in China, degradable polymer materials such as polylactic acid, polyesters, and polyhydroxyalkanoates are being developed as the times require. The degradable polymer materials have similar properties to traditional polymer materials, but the degradable polymer materials can rapidly degrade only under harsh conditions such as composting, and degradation products such as water and carbon dioxide from the degradable polymer materials cannot be recycled.

In recent years, degradable polymer materials represented by PTA and derivatives thereof have been favored due to characteristics such as modifiable side chains, mild degradation conditions, recyclable degraded monomers, and low cost. The corresponding basic research and applied basic research on the degradable polymer materials are growing explosively. The dynamic disulfide bonds in PTA are beneficial for both the construction of a thermoplastic material and the degradation of a polymer. For example, PTA can be degraded to a thioctic acid (TA) monomer by a reducing agent or an alkaline solution under mild conditions, and the monomer obtained after degradation can be recovered and used to prepare the corresponding PTA, thereby realizing the recycling of the material. The TA monomer is a class of small molecules with very high biosafety, and can be used to prepare a hydrogel for cell cultivation and a drug carrier. In addition, TA, as one of the B vitamins, has excellent inoxidizability and can induce the apoptosis of various cancer cells. Therefore, the development of polymer materials based on TA and derivatives thereof not only has important application potential in the field of degradable engineering materials, but also will shine in the field of degradable biomedical materials.

However, the current methods for the preparation of PTA mainly are limited to two aspects: thermal polymerization and photoinitiated polymerization. The thermal polymerization is mainly performed by heating and melting a TA monomer to initiate polymerization using the resulting free radicals. This method does not require a solvent, but the thermal polymerization process is also accompanied by the thermal depolymerization of a polymer. The mutually contradictory characteristics of this method greatly limit the degree of polymerization of the resulting polymer, so that the polymer has a low molecular weight and an insufficient purity, which seriously affects the final performance of the polymer material. In addition, this method is not suitable for the polymerization of a TA derivative with a high melting point. The photopolymerization method requires a long polymerization time and a high laser power, and requires the monomers of TA and derivatives thereof to form an ultrathin film with high light transmittance in advance, which limits the application scope of the photoinitiated polymerization. In order to overcome the shortcomings of the current polymerization strategies, improve the performance of PTA and derivatives thereof, and expand the application of PTA and derivatives thereof, it is urgent to develop a novel polymerization method.

SUMMARY

In view of this, the present disclosure is intended to provide a method for electrochemical preparation of PTA and a derivative thereof. The method provided by the present disclosure is simple, fast, efficient, and applicable to a wide range of monomer types, and the PTA and derivative thereof obtained by the method have a high degree of polymerization and a high purity.

To realize the above object, the present disclosure provides the following technical solutions:

The present disclosure provides a method for electrochemical preparation of PTA and a derivative thereof, including:

mixing a TA monomer, a supporting electrolyte, and a polar solvent to obtain a mixed liquor; and subjecting the mixed liquor to electrochemical polymerization to obtain the PTA and/or the derivative thereof on a surface of an anode, wherein the TA monomer includes one or more selected from the group consisting of TA and a TA derivative, and the TA derivative has a structure shown in formula I:

formula I

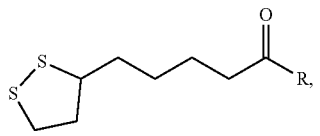

wherein R is a derived group.

In some embodiments, the electrochemical polymerization is conducted by at least one mode selected from the group consisting of chronoamperometry, chronopotentiometry, and cyclic voltammetry.

In some embodiments, the electrochemical polymerization is conducted by a process including:

adopting Ag/AgCl as a reference electrode, a platinum wire as a counter electrode, and a platinum sheet or a gold sheet as a working electrode, and applying an oxidation voltage to the working electrode.

In some embodiments, the electrochemical polymerization is conducted by a process including:

adopting a platinum wire as a cathode and a platinum sheet as an anode, and applying an oxidation voltage to the anode.

In some embodiments, the chronoamperometry is conducted at an anode voltage of higher than or equal to 0.99 V;

the chronopotentiometry is conducted at a current of higher than or equal to 0.1 A; and the cyclic voltammetry is conducted at a voltage of 0.7 V to 1.7 V.

In some embodiments, the electrochemical polymerization is conducted for 10 s to 30 s.

In some embodiments, the supporting electrolyte is one or more selected from the group consisting of potassium chloride, tetrabutyl hexafluorophosphate, and lithium perchlorate; and the supporting electrolyte in the mixed liquor has a concentration of 0.5 mol/L to 1.5 mol/L.

In some embodiments, the TA monomer in the mixed liquor has a concentration of 0.10 g/mL to 1.00 g/mL.

In some embodiments, the polar solvent is one or more selected from the group consisting of water, acetonitrile, and tetrahydrofuran.

In some embodiments, under the condition that the polar solvent is water, the method further includes adjusting a pH of the mixed liquor to 6.5 to 7.5.

The present disclosure provides a method for electrochemical preparation of PTA and a derivative thereof, including: mixing a TA monomer, a supporting electrolyte, and a polar solvent to obtain a mixed liquor; and subjecting the mixed liquor to electrochemical polymerization to obtain the PTA and/or the derivative thereof on a surface of an anode in an electrolytic cell, wherein the TA monomer includes one or more selected from the group consisting of TA and a TA derivative, and the TA derivative has a structure shown in formula I. In the present disclosure, ring-opening polymerization can be realized for the first time by electrochemical oxidation based on the unique redox performance of cyclic dithiolane in TA and a derivative thereof. An oxidation voltage of a 0.10 g/mL TA solution is 0.99 V (vs. Ag/AgCl), and as a result, after applying the oxidation voltage to the working electrode, the PTA or the derivative thereof can be produced at the working electrode within 30 s.

The method provided by the present disclosure can be carried out at room temperature. In the method, only TA is dissolved in the electrolyte. The method has simple preparation operations and an efficient and rapid polymerization reaction, and meets the needs of green chemistry. Compared with the PTA prepared by the traditional thermal polymerization or photopolymerization method, the PTA prepared according to the present disclosure has advantages such as large molecular weight and high purity.

In addition, the present disclosure has a certain universality to the TA derivatives, and all TA monomers containing a TA structure are applicable to the method of the present disclosure.

The PTA and the derivative thereof prepared by the method of the present disclosure also have a specific shear strength under water, which lays a foundation for the development of TA medical adhesives in combination with strong oxidation of TA.

DETAILED DESCRIPTION OF THE EMBODIMENTS

Figure 1:
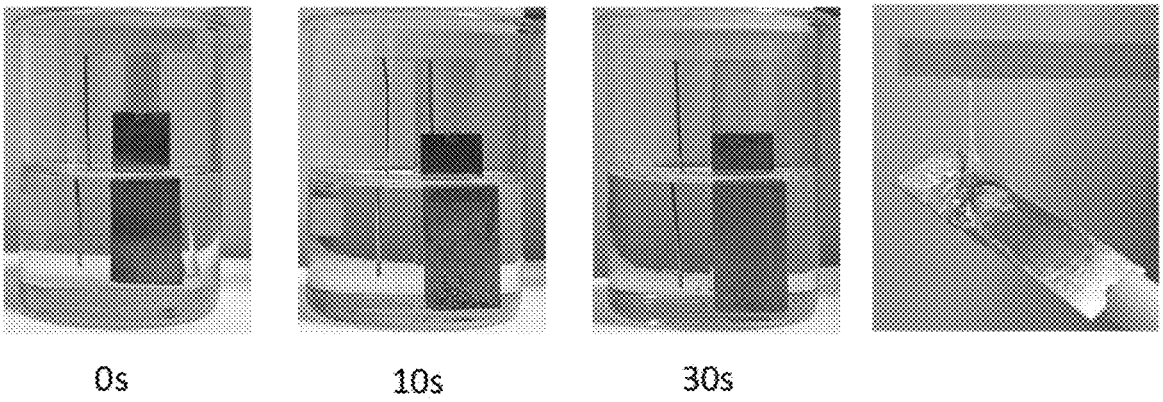
FIG. 1 shows physical pictures of the electrochemically prepared PTA in Example 1.

The present disclosure provides a method for electrochemical preparation of PTA and a derivative thereof, including:

mixing a TA monomer, a supporting electrolyte, and a polar solvent to obtain a mixed liquor; and subjecting the mixed liquor to electrochemical polymerization to obtain the PTA and/or the derivative thereof on a surface of an anode in an electrolytic cell.

In the present disclosure, the TA monomer includes one or more selected from the group consisting of TA and a TA derivative, and the TA derivative has a structure shown in formula I:

formula I

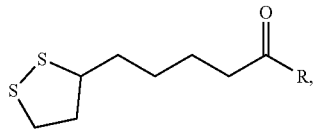

wherein R is a derived group.

There are no special requirements for the specific structure of the derived group, and any TA compound having the structure of

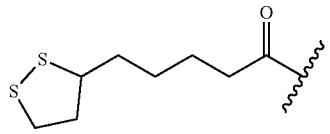

is applicable to the electrochemical preparation method of the present disclosure. There are no special requirements for the source of the TA derivative, and any conventional TA derivative that is commercially available in the art or homemade may be adopted.

As some specific embodiments of the present disclosure, the TA derivative has a structure shown in any one of formulas a to 1:

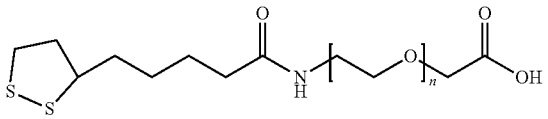

formula a, wherein n is in a range of 40 to 50;

formula b

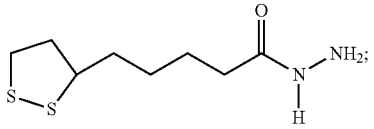

formula c

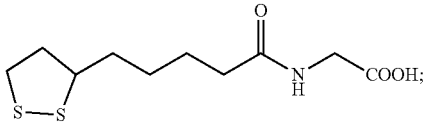

formula d

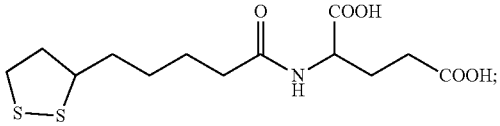

formula e

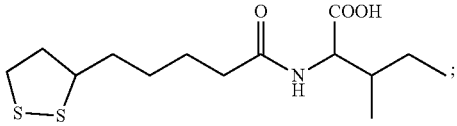

formula f

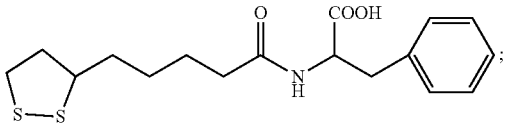

formula g

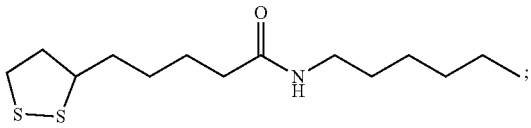

formula h

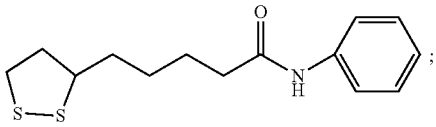

formula i

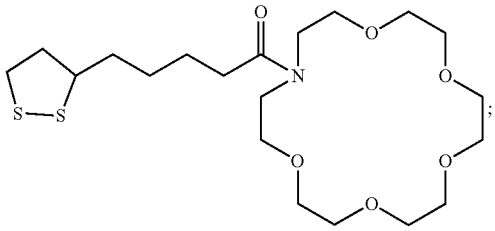

formula j

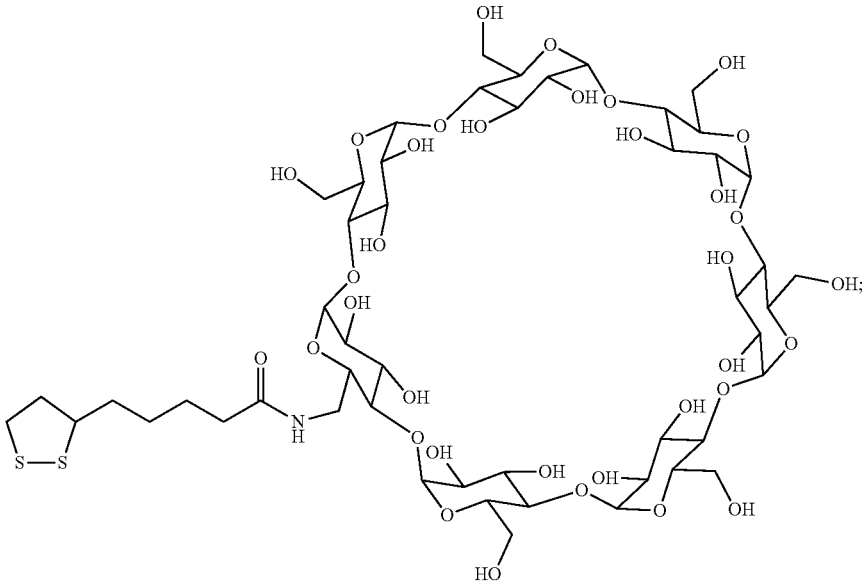

formula k

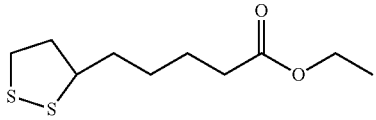

and formula l

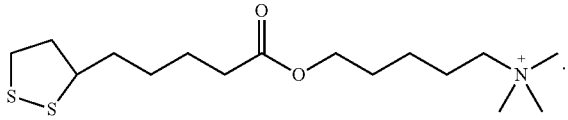

In the present disclosure, a TA monomer, a supporting electrolyte, and a polar solvent are mixed to obtain a mixed liquor. In some embodiments of the present disclosure, the supporting electrolyte is one or more selected from the group consisting of potassium chloride, tetrabutyl hexafluorophosphate, and lithium perchlorate, and preferably potassium chloride.

In some embodiments of the present disclosure, the polar solvent is one or more selected from the group consisting of water, acetonitrile, and tetrahydrofuran, and preferably water.

There are no special requirements for the manner of the mixing, and a mixing manner well known to those skilled in the art may be adopted, such as stirring.

In some embodiments of the present disclosure, in the mixed liquor, the TA monomer has a concentration of 0.1 g/mL to 1.0 g/mL, and preferably 0.27 g/mL; and the supporting electrolyte has a concentration of 0.5 mol/L to 1.5 mol/L, and preferably 1.0 mol/L.

In some embodiments of the present disclosure, under the condition that the polar solvent is water, the method further includes adjusting a pH of the mixed liquor to 6.5 to 7.5, and preferably 7.0. In some embodiments of the present disclosure, a pH adjusting agent for adjusting the pH is NaOH.

In the present disclosure, the mixed liquor is subjected to electrochemical polymerization to obtain the PTA or the derivative thereof on a surface of an anode in an electrolytic cell.

In some embodiments of the present disclosure, the electrochemical polymerization is conducted by at least one mode selected from the group consisting of chronoamperometry, chronopotentiometry, and cyclic voltammetry.

In some embodiments of the present disclosure, under the condition that the electrochemical polymerization is conducted by chronoamperometry, the anode has a voltage of higher than or equal to 0.99 V, and preferably 1.5 V.

In some embodiments of the present disclosure, under the condition that the electrochemical polymerization is conducted by chronopotentiometry, the chronopotentiometry is conducted at a current of higher than or equal to 0.1 A.

In some embodiments of the present disclosure, under the condition that the electrochemical polymerization is conducted by cyclic voltammetry, the cyclic voltammetry is conducted at a voltage of 0.7 V to 1.7 V.

In some embodiments of the present disclosure, the electrochemical polymerization is conducted by a process including:

adopting Ag/AgCl as a reference electrode, a platinum wire as a counter electrode, and a platinum sheet or a gold sheet as a working electrode, and applying an oxidation voltage to the working electrode.

Alternatively, in some embodiments, the electrochemical polymerization is conducted by a process including:

adopting a platinum wire as a cathode, and a platinum sheet as an anode, and applying an oxidation voltage to the anode.

In some embodiments of the present disclosure, the electrochemical polymerization is conducted for 10 s to 30 s, and preferably 20 s to 30 s.

The electrochemical preparation method provided by the present disclosure overcomes shortcomings such as complicated conditions, long time, low degree of polymerization, poor purity, and few monomer types of the traditional thermal polymerization and photopolymerization methods, greatly expands the material types of the PTA and the derivative thereof, and will lay a foundation for the development of functional degradable polymer materials. Compared with the PTA prepared by the traditional thermal polymerization or photopolymerization method, the PTA prepared according to the present disclosure has advantages such as large molecular weight and high purity.

The method for electrochemical preparation of PTA and a derivative thereof provided by the present disclosure will be described in detail below with reference to the examples, but they should not be construed as limiting the protection scope of the present disclosure.

Example 1

4.0 g of a TA monomer was dissolved in 15 mL of a KCl aqueous solution with a concentration of 1 mol/L, obtaining a mixed liquor. A pH of the mixed liquor was adjusted to 7.0 with sodium hydroxide, obtaining a TA monomer aqueous solution in which a concentration of the TA monomer was 0.27 g/mL. The obtained TA monomer aqueous solution containing the TA monomer, KCl, and NaOH was used as an electrolyte, Ag/AgCl as a reference electrode, a platinum wire as a counter electrode, and a 10 mm×30 mm platinum sheet as a working electrode were connected to an electrochemical workstation to assemble an electrochemical polymerization device. The electrochemical polymerization was conducted by chronoamperometry for 100 s with the working electrode as an anode and an anode voltage set to 1.5 V.

Physical pictures of the PTA products (Electrial PTA, hereafter EPTA) prepared under different electrochemical polymerization conditions are shown in FIG. 1. It can be seen from FIG. 1 that a visible PTA is formed at the anode immediately after a direct current is applied; after the electrochemical polymerization is conducted for 10 s, a specified amount of EPTA is produced at the anode, and the EPTA is a translucent jelly with a specified viscosity; and after the electrochemical polymerization is conducted for 30 s, the EPTA no longer increases with the extension of the electrochemical polymerization, indicating that the electrochemical polymerization is basically completed.

Figure 2:
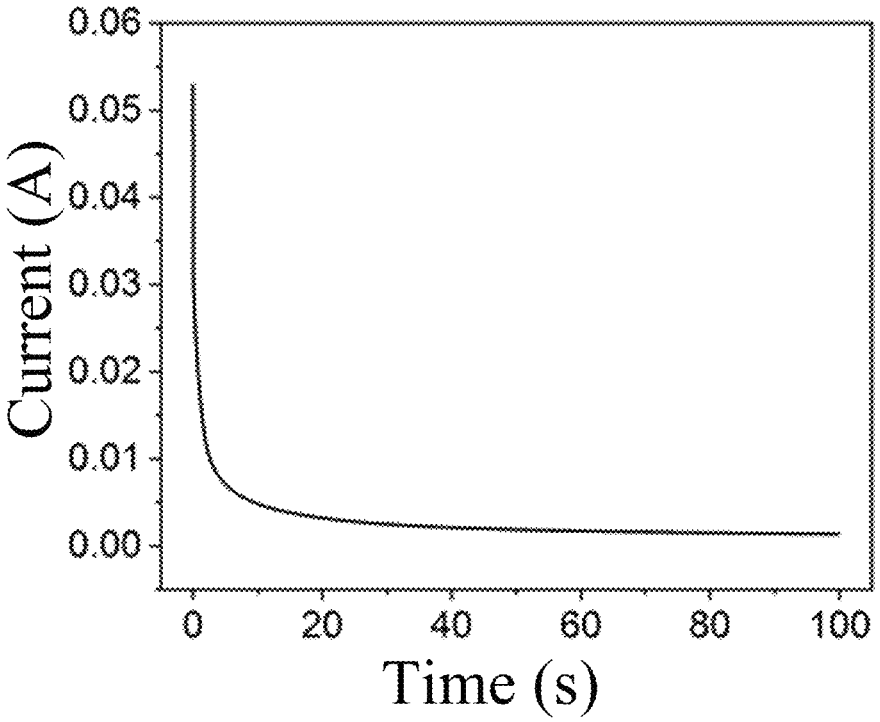
FIG. 2 shows a chronoamperometric curve of the electrochemically prepared PTA in Example 1.

A chronoamperometric curve of the electrochemically prepared PTA is shown in FIG. 2. It can be seen from FIG. 2 that as the reaction time increases, the current drops sharply over time within 30 s, and then remains basically unchanged.

Figure 3:
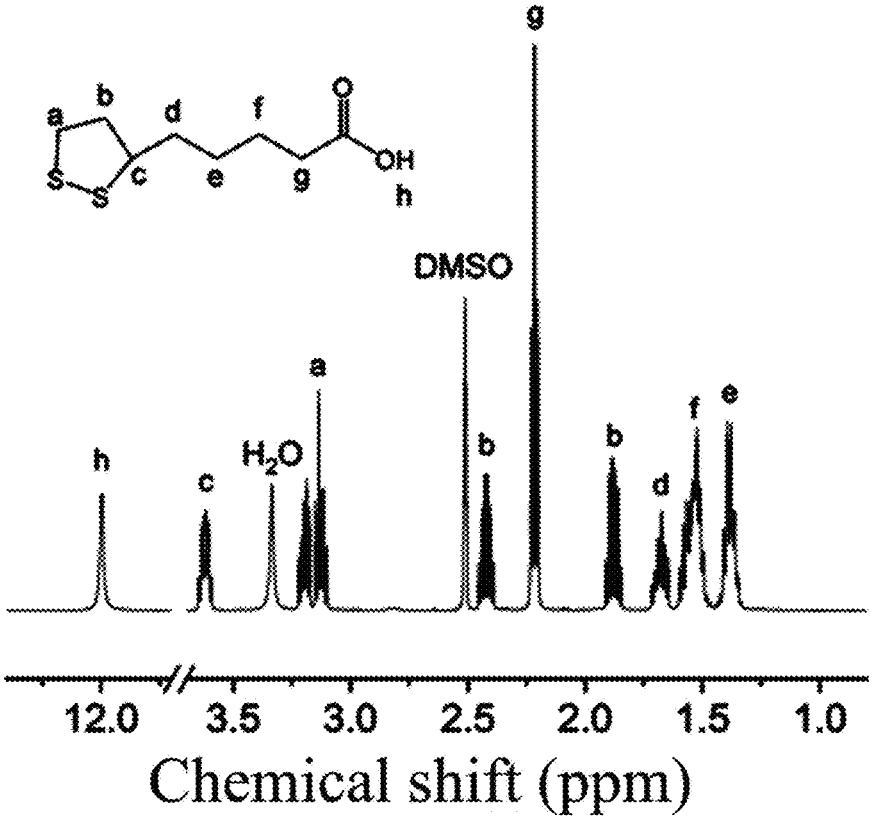
FIG. 3 shows a hydrogen nuclear magnetic resonance (HNMR) spectrum of the TA monomer.
Figure 4:
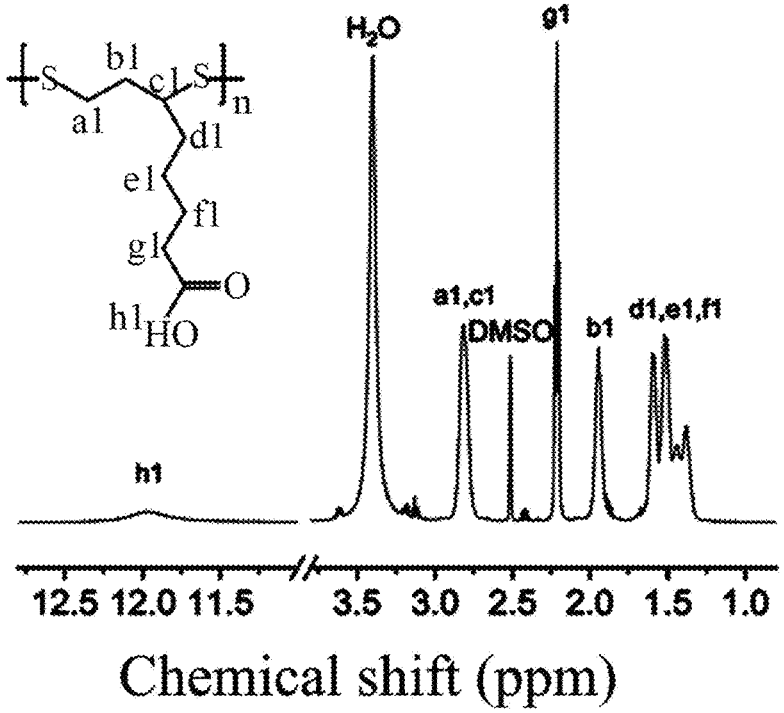
FIG. 4 shows an HNMR spectrum of the PTA prepared in Example 1.

An HNMR spectrum of the TA monomer is shown in FIG. 3 and an HNMR spectrum of the prepared PTA is shown in FIG. 4. Compared with the HNMR spectrum of the TA monomer, it can be seen from the HNMR spectrum of the PTA that the split peaks attributing to the alkyl-chain methylene groups d, e, and f in the PTA are fused and broadened. This is because the molecular weight increases after polymerization, resulting in a longer relaxation time and a broader spectral line. Meanwhile, the chemical shifts of a methylene proton a and a methylene proton c attributing to dithiolane chemically shift to 2.95 ppm in a direction from a high field to a low field, and the peaks overlap and broaden. In addition, the signals of non-corresponding protons b of methylene on dithiolane coincide at 2.13 ppm (b1). A characteristic peak of carboxyl appears at 12 ppm, indicating that the PTA has a significant proton sponge effect, resulting in the production of protonated carboxyl. Due to the adsorption effect of the PTA, a trace of a monomer impurity peak also appears, but no other peaks appear, indicating that there are no other by-products other than the PTA.

Figure 5:
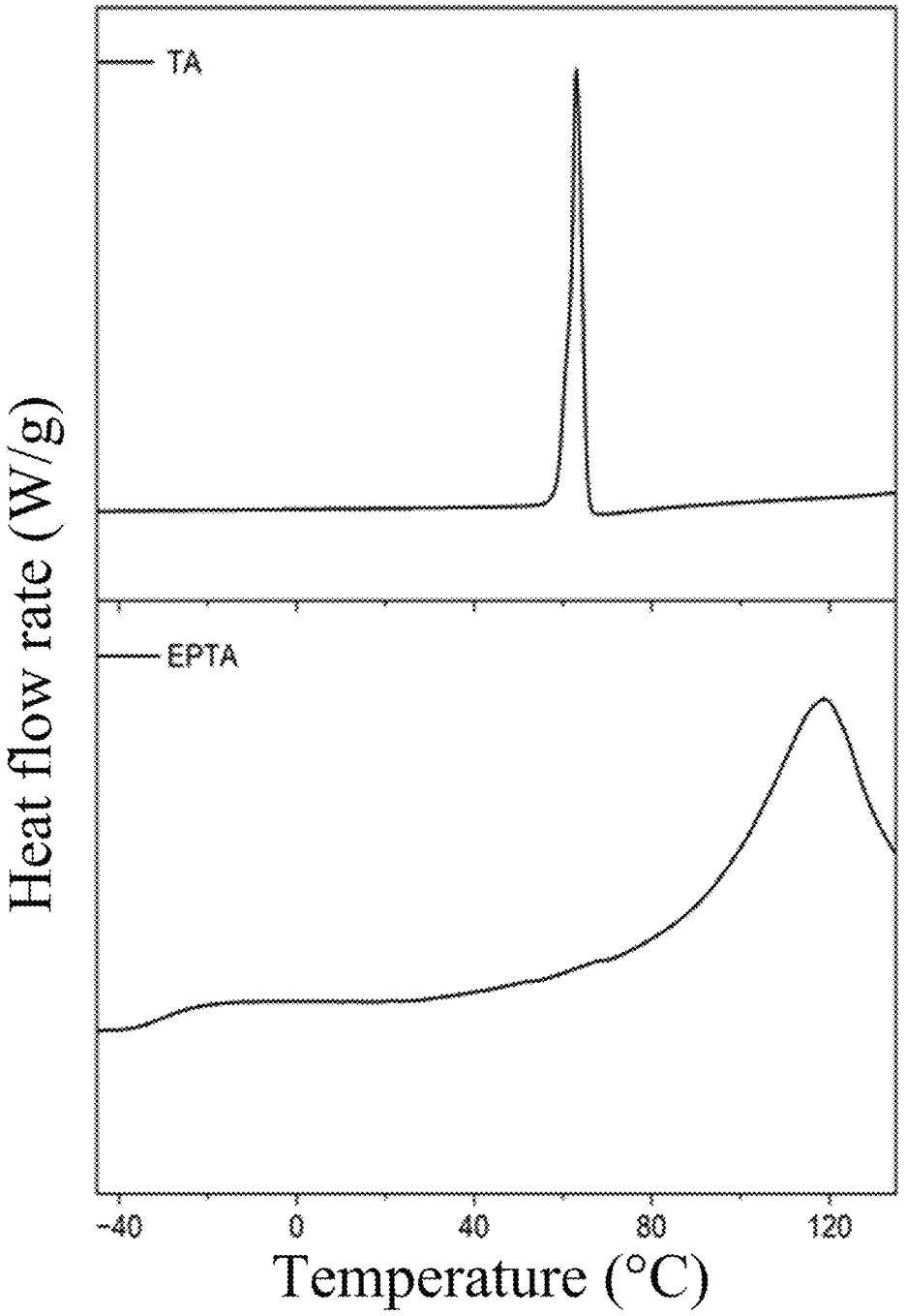
FIG. 5 shows a differential scanning calorimetry (DSC) graph of the PTA prepared in Example 1.

A DSC graph of the prepared PTA is shown in FIG. 5. It can be seen from FIG. 5 that the TA monomer has a spike at 60° C., which corresponds to the characteristic melting peak of the TA monomer.

Figure 6:
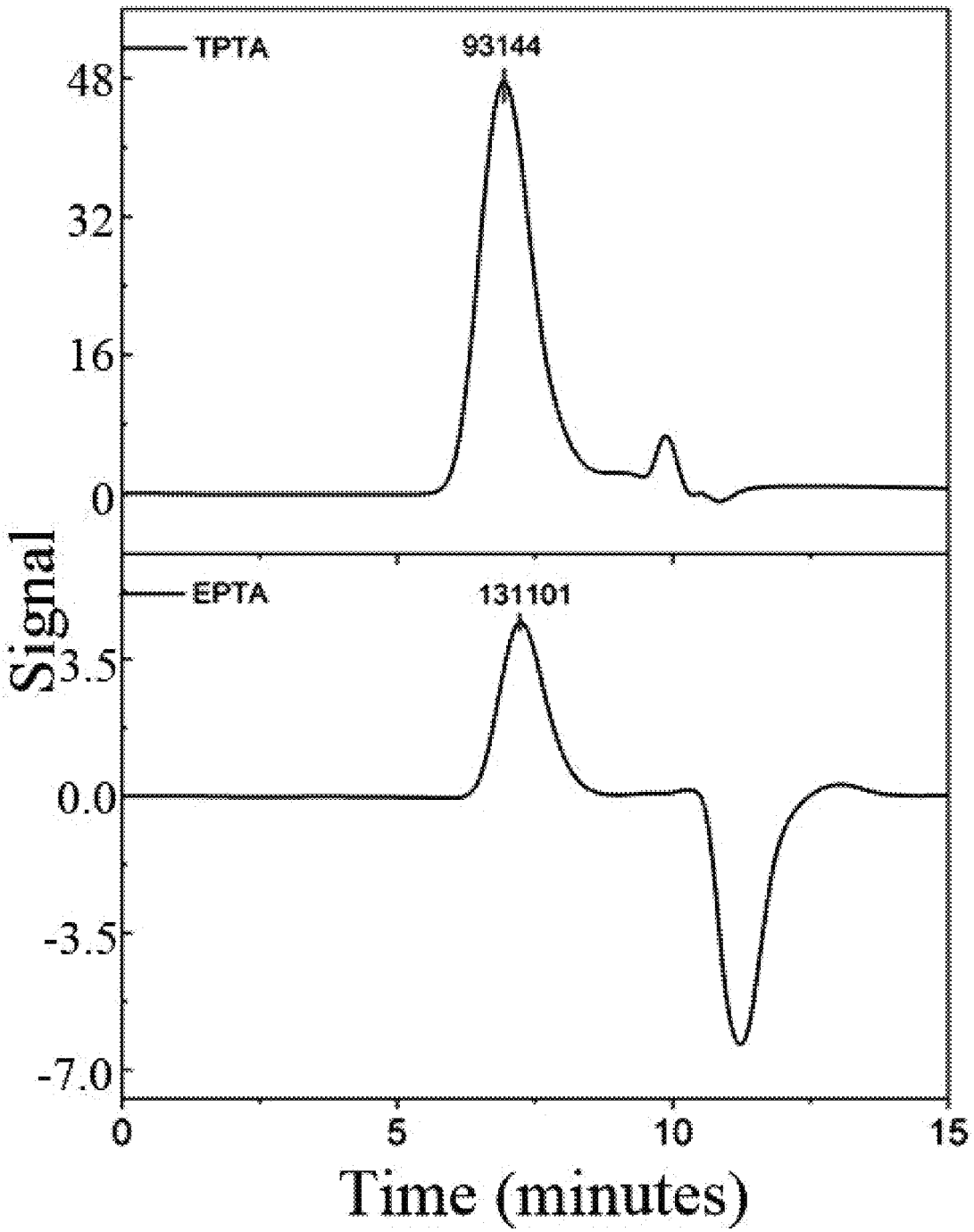
FIG. 6 is a gel permeation chromatogram showing the comparative result of the PTA prepared by thermal polymerization in the control group and the PTA prepared in Example 1.

1 g of a TA monomer was added to a 10 mL round-bottomed flask and heated in an oil bath at 70° C. for 2 min, obtaining a thermally-polymerized PTA (TPTA). Gel permeation chromatograms of TPTA and the EPTA are shown in FIG. 6. It can be seen that the PTA prepared by electrochemical polymerization has a number-average molecular weight of 79,361 g/mol and a weight-average molecular weight of 131,101 g/mol, and the PTA prepared by thermal polymerization has a number-average molecular weight of 40,807 g/mol and a weight-average molecular weight of 93,144 g/mol, indicating that the PTA prepared by electrochemical polymerization has a higher degree of polymerization.

Due to the fact that the PTA has a specific adhesive effect, the adhesive performance of the electrochemically prepared PTA was further tested. A lap shear test was conducted on a solid substrate with a width of 0.8 cm and a length of 8 cm, such as stainless steel, glass, polypropylene, and polyetheretherketone, wherein a lap length was 1.2 cm, a maximum load force when the adhesion was broken was measured by a universal test machine, and the maximum load force was divided by a lap shear area to obtain a shear strength.

Figure 7:
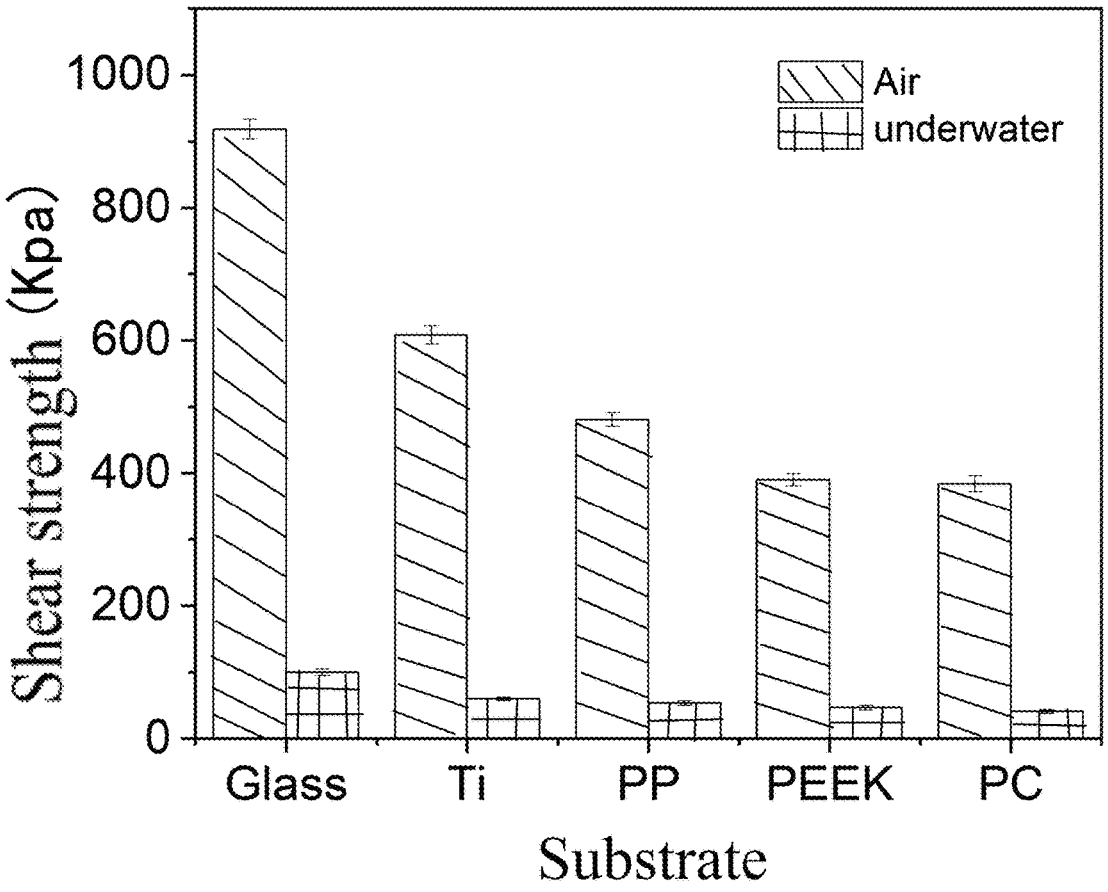
FIG. 7 shows test results of the adhesive performance of the PTA prepared in Example 1.

The test results of the adhesive performance of the prepared PTA to the solid materials such as stainless steel, glass, polypropylene, and polyetheretherketone are shown in FIG. 7. It can be seen that the dry shear strengths of the prepared PTA as an adhesive to glass, titanium, polypropylene, polyetheretherketone, and polycarbonate are 918.51±15.27 kPa, 608.12±13.63 kPa, 480.6±9.4 kPa, 390.46±15.24 kPa, and 384.29±10.35 kPa, respectively, and the underwater shear strengths of the prepared PTA to glass, titanium, polypropylene, polyetheretherketone, and polycarbonate are 99.56±4.96 kPa, 59.8±2.62 kPa, 53.42±2.83 kPa, 46.64±3.48 kPa, and 41.04±3.30 kPa, respectively.

Example 2

Figure 8:
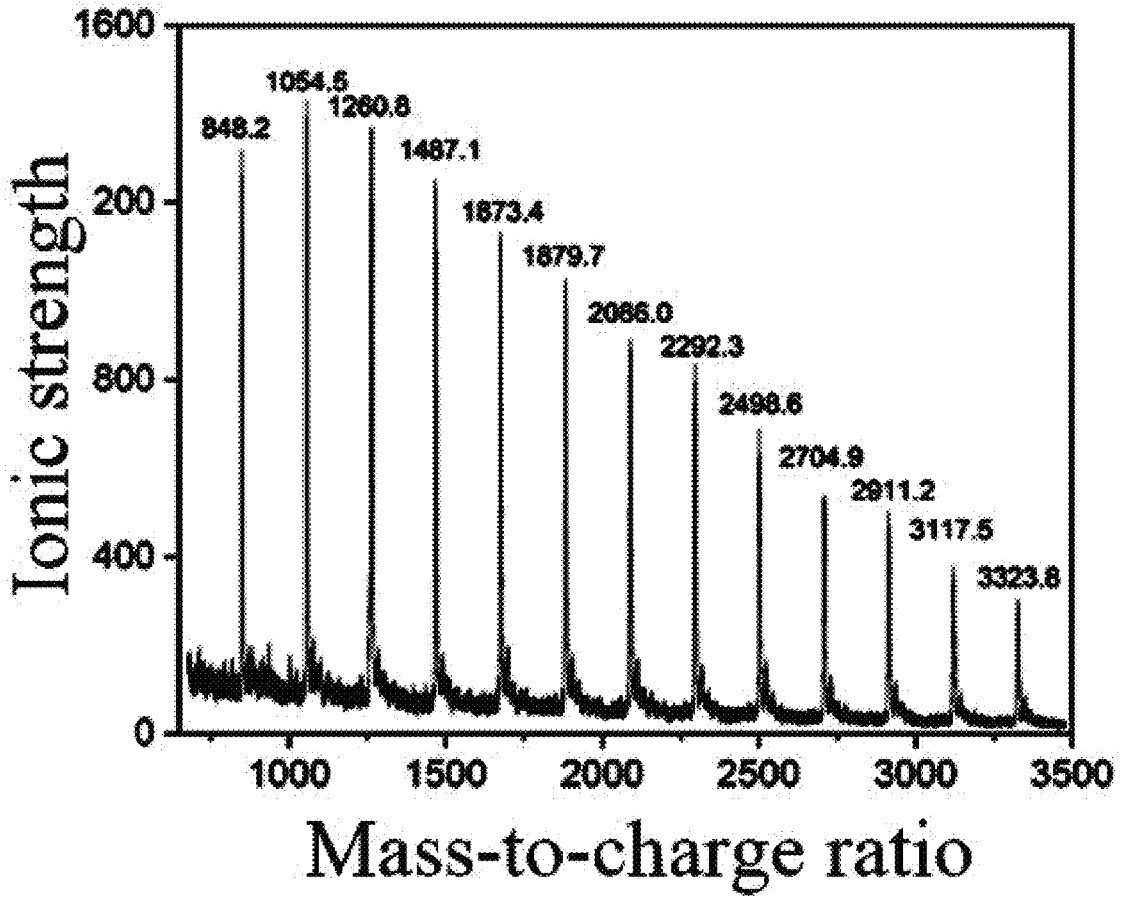
FIG. 8 is a matrix-assisted time-of-flight mass spectrometry spectrum of the PTA prepared in Example 2.

This example was basically the same as Example 1, except that the amount of the TA was changed from 4 g to 4.5 g, obtaining PTA at an anode of an electrolytic cell. A matrix-assisted time-of-flight mass spectrometry spectrum of the prepared PTA is shown in FIG. 8.

Example 3

This example was basically the same as Example 1, except that the anode voltage was changed from 1.5 V to 2.0 V, obtaining PTA at an anode of an electrolytic cell. A matrix-assisted time-of-flight mass spectrometry spectrum of the PTA is similar to FIG. 8.

Example 4

This example was basically the same as Example 1, except that the preparation method was changed from chronoamperometry to chronopotentiometry and the current was set to 0.1 A, obtaining PTA at an anode of an electrolytic cell. A matrix-assisted time-of-flight mass spectrometry spectrum of the PTA is similar to FIG. 8.

Example 5

This example was basically the same as Example 1, except that the preparation method was changed from chronoamperometry to cyclic voltammetry and the voltage range was set to a range of 0.7 V to 1.7 V, obtaining PTA at an anode of an electrolytic cell. A matrix-assisted time-of-flight mass spectrometry spectrum of the PTA is similar to FIG. 8.

Example 6

This example was basically the same as Example 1, except that the working electrode was changed from the platinum sheet to a gold sheet, obtaining PTA at an anode of an electrolytic cell. A matrix-assisted time-of-flight mass spectrometry spectrum of the PTA is similar to FIG. 8.

Example 7

This example was basically the same as Example 1, except that the three-electrode system was replaced with a two-electrode system, a platinum wire was used as a cathode, a 10 mm×30 mm platinum sheet was used as an anode, and an anode voltage was 2.40 V, such as obtaining PTA at the anode of an electrolytic cell. A matrix-assisted time-of-flight mass spectrometry spectrum of the PTA is similar to FIG. 8.

Example 8

Figure 9:
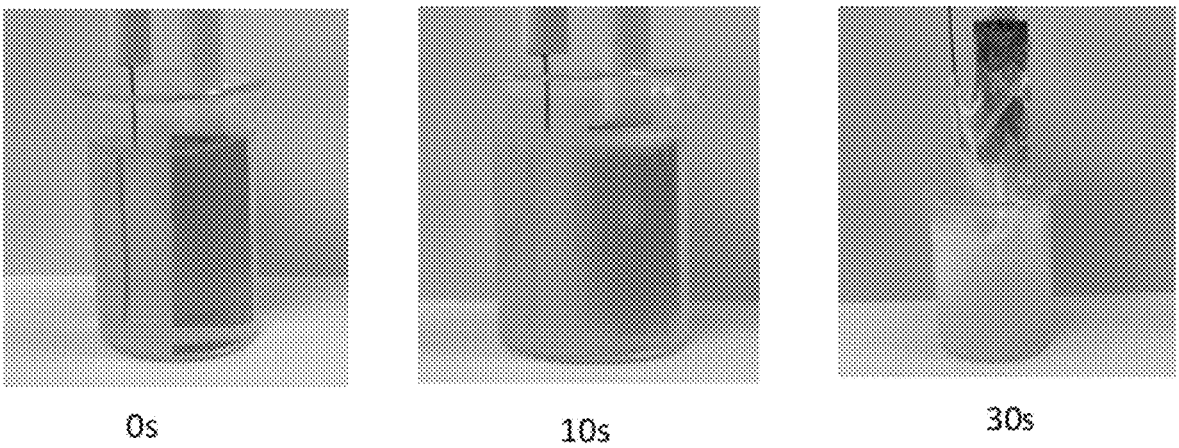
FIG. 9 shows physical pictures of the PTA prepared in Example 8.

500 mg of a TA monomer was dissolved in 5 mL of an acetonitrile solution, and 500 mg of tetrabutyl hexafluorophosphate was added thereto as a supporting electrolyte; and a two-electrode system with a platinum wire as a cathode and a 10 mm×30 mm platinum sheet as an anode was used to conduct electrochemical polymerization for 30 s at an anode voltage of 1.80 V, obtaining a large amount of PTA. Physical pictures of the PTA products are shown in FIG. 9.

Example 9

Figure 10:
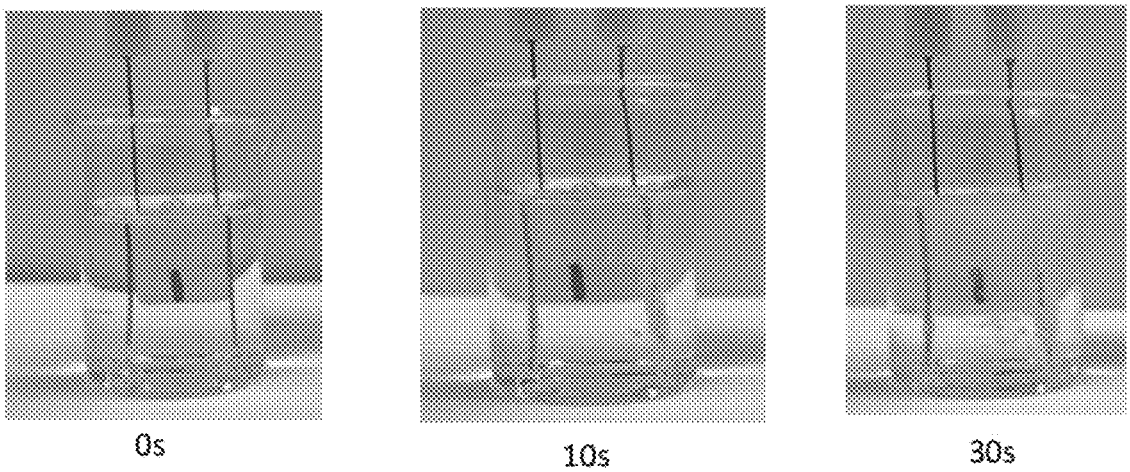
FIG. 10 shows physical pictures of the polythioctic acyldhydrazine prepared in Example 9.

This example was basically the same as Example 1, except that the TA monomer was replaced with a TA derivative, thioctic acyldhydrazine, obtaining polythioctic acyldhydrazine at an anode of an electrolytic cell. Physical pictures of the polythioctic acyldhydrazine are shown in FIG. 10.

The thioctic acyldhydrazine has a structure shown in formula b:

formula b

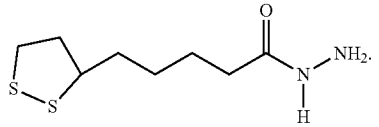

The polythioctic acyldhydrazine has a number-average molecular weight of 26,557 g/mol and a weight-average molecular weight of 61,506 g/mol.

Example 10

This example was basically the same as Example 1, except that the TA monomer was replaced with a TA derivative, thioctic acylpolyethylene glycol, obtaining polythioctic acylpolyethylene glycol at an anode of an electrolytic cell.

The thioctic acylpolyethylene glycol has a molecular weight of 2,000±200 and a structure shown in formula a:

formula a

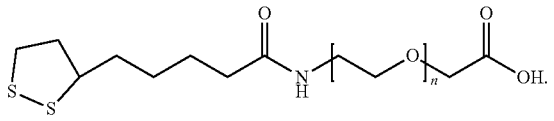

Figure 11:
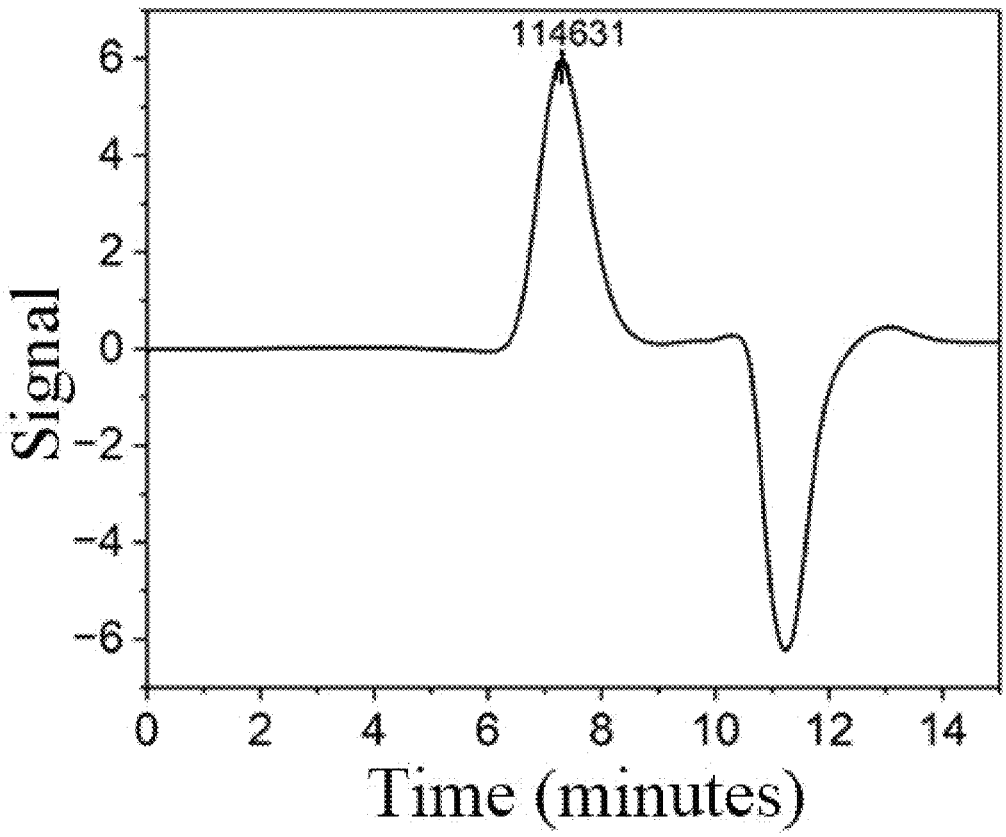
FIG. 11 shows a gel permeation chromatogram of the polythioctic acylpolyethylene glycol prepared in Example 10.

A gel permeation chromatogram of the polythioctic acypolyethylene glycol is shown in FIG. 11, and it can be seen that the polythioctic acypolyethylene glycol has a number-average molecular weight of 64,096 g/mol and a weight-average molecular weight of 150,778 g/mol.

Example 11

This example was basically the same as Example 1, except that the polar solvent was changed to an acetonitrile solution, the supporting electrolyte was changed to tetrabutyl hexafluorophosphate, and the TA monomer was replaced with a TA derivative, thioctic acylglycine, obtaining polythioctic acylglycine at an anode of an electrolytic cell.

The thioctic acylglycine has a structure shown in formula c:

formula c

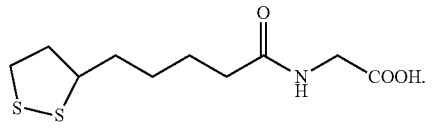

Example 12

This example was basically the same as Example 1, except that the polar solvent was changed to an acetonitrile solution, the supporting electrolyte was changed to tetrabutyl hexafluorophosphate, and the TA monomer was replaced with a TA derivative, thioctic acylglutamate, obtaining polythioctic acylglutamate at an anode of an electrolytic cell.

The thioctic acylglutamate has a structure shown in formula d:

formula d

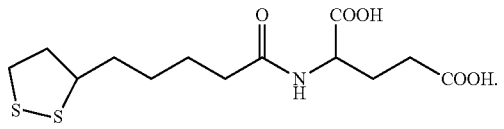

Example 13

This example was basically the same as Example 1, except that the polar solvent was changed to an acetonitrile solution, the supporting electrolyte was changed to tetrabutyl hexafluorophosphate, and the TA monomer was replaced with a TA derivative, thioctic acylisoleucine, obtaining polythioctic acylisoleucine at an anode of an electrolytic cell.

The thioctic acylisoleucine has a structure shown in formula e:

formula e

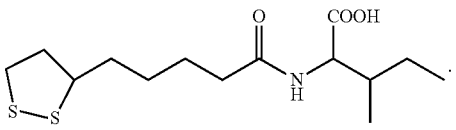

Example 14

This example was basically the same as Example 1, except that the polar solvent was changed to an acetonitrile solution, the supporting electrolyte was changed to tetrabutyl hexafluorophosphate, and the TA monomer was replaced with a TA derivative, thioctic acylphenylalanine, obtaining polythioctic acylphenylalanine at an anode of an electrolytic cell.

The thioctic acylphenylalanine has a structure shown in formula f:

formula f

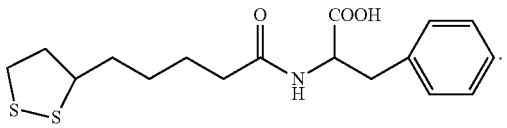

Example 15

This example was basically the same as Example 1, except that the polar solvent was changed to an acetonitrile solution, the supporting electrolyte was changed to tetrabutyl hexafluorophosphate, and the TA monomer was replaced with a TA derivative, thioctic hexylamide, obtaining poly-thioctic hexylamide at an anode of an electrolytic cell.

The thioctic hexylamide has a structure shown in formula g:

formula g

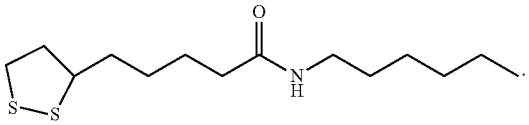

Example 16

This example was basically the same as Example 1, except that the polar solvent was changed to an acetonitrile solution, the supporting electrolyte was changed to tetrabutyl hexafluorophosphate, and the TA monomer was replaced with a TA derivative, thioctic acylbenzene, obtaining polythioctic acylbenzene at an anode of an electrolytic cell.

The thioctic acylbenzene has a structure shown in formula h:

formula h

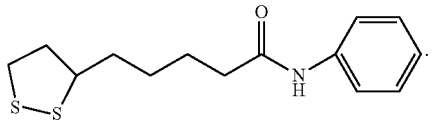

Example 17

This example was basically the same as Example 1, except that the polar solvent was changed to an acetonitrile solution, the supporting electrolyte was changed to tetrabutyl hexafluorophosphate, the TA monomer was replaced with a TA derivative, thioctic acylcrown ether, obtaining polythioctic acylcrown ether at an anode of an electrolytic cell.

The thioctic acylcrown ether has a structure shown in formula i:

formula i

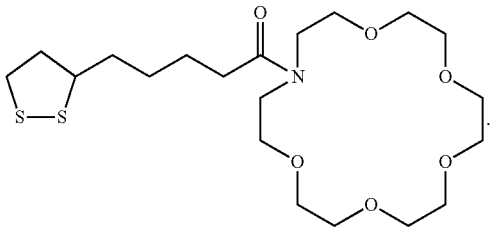

Example 18

This example was basically the same as Example 1, except that the polar solvent was changed to an acetonitrile solution, the supporting electrolyte was changed to tetrabutyl hexafluorophosphate, and the TA monomer was replaced with a TA derivative, thioctic acylcyclodextrin, obtaining polythioctic acylcyclodextrin at an anode of an electrolytic cell.

The thioctic acylcyclodextrin has a structure shown in formula j:

formula j

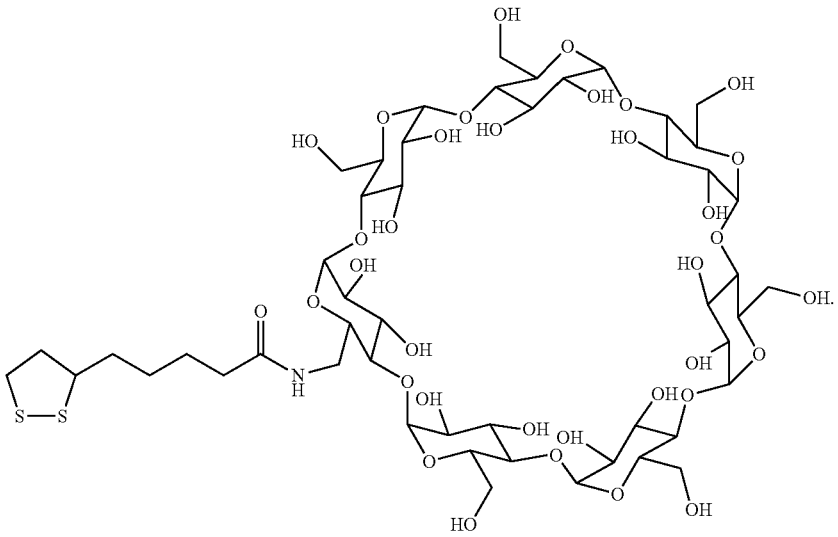

Example 19

This example was basically the same as Example 1, except that the polar solvent was changed to an acetonitrile solution, the supporting electrolyte was changed to tetrabutyl hexafluorophosphate, and the TA monomer was replaced with a TA derivative of ethyl thioctate, obtaining polyethyl thioctate at an anode of an electrolytic cell.

The ethyl thioctate has a structure shown in formula k:

formula k

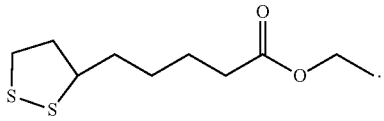

Example 20

This example was basically the same as Example 1, except that the polar solvent was changed to an acetonitrile solution, the supporting electrolyte was changed to tetrabutyl hexafluorophosphate, and the TA monomer was replaced with a TA derivative, N,N,N-trimethylpenamine thioctate such as obtaining poly-N,N,N-trimethylpenamine thioctate at an anode of an electrolytic cell.

The N,N,N-trimethylpenamine thioctate has a structure shown in formula 1:

formula 1

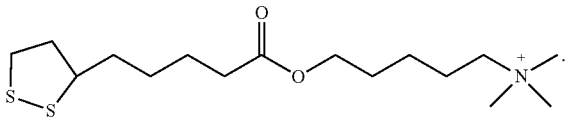

Comparative Example 1

This comparative example was basically the same as Example 1, except that the amount of the TA was changed from 4 g to 7.0 g. Because the solution is too viscous, it is difficult for the TA monomer to move towards the electrode, and thus jelly-like PTA cannot be produced at an anode of an electrolytic cell. The solution only turns white and turbid.

Comparative Example 2

This comparative example was basically the same as Example 1, except that the anode voltage was changed from 1.5 V to 0.8 V and PTA was not produced at an anode of an electrolytic cell.

The above are merely the preferred embodiments of the present disclosure. It should be understood that for those of ordinary skill in the art, several improvements and modifications could be made without departing from the principle of the present disclosure, and those improvements and modifications should be regarded as falling within the scope of the present disclosure.

What is claimed is:

1. A method for electrochemical preparation of polythioctic acid (PTA) and a derivative thereof, comprising:

mixing a thioctic acid (TA) monomer, a supporting electrolyte, and a polar solvent to obtain a mixed liquor; and subjecting the mixed liquor to electrochemical polymerization to obtain the PTA and/or the derivative thereof on a surface of an anode, wherein the TA monomer comprises one or more selected from the group consisting of TA and a TA derivative, and the TA derivative has a structure shown in formula I:

formula I

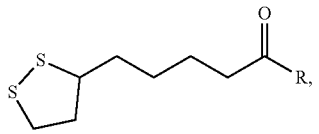

wherein R is a derived group;

wherein the electrochemical polymerization is conducted by at least one mode selected from the group consisting of chronoamperometry; and chronopotentiometry, wherein under a condition that the electrochemical polymerization is conducted by the chronoamperometry, the chronoamperometry is conducted at an anode voltage of higher than or equal to 0.99 V; under a condition that the electrochemical polymerization is conducted by the chronopotentiometry, the chronopotentiometry is conducted at a current of higher than or equal to 0.1 A; and the TA monomer in the mixed liquor has a concentration of 0.10 g/mL to 0.27 g/mL.

2. The method of claim 1, wherein the electrochemical polymerization is conducted by a process comprising:

adopting Ag/AgCl as a reference electrode, a platinum wire as a counter electrode, and a platinum sheet or a gold sheet as a working electrode, and applying an oxidation voltage to the working electrode.

3. The method of claim 1, wherein the electrochemical polymerization is conducted by a process comprising:

adopting a platinum wire as a cathode and a platinum sheet as an anode, and applying an oxidation voltage to the anode.

4. The method of claim 1, wherein the electrochemical polymerization is conducted for 10 s to 30 s.

5. The method of claim 1, wherein the supporting electrolyte is one or more selected from the group consisting of potassium chloride, tetrabutyl hexafluorophosphate, and lithium perchlorate; and the supporting electrolyte in the mixed liquor has a concentration of 0.5 mol/L to 1.5 mol/L.

6. The method of claim 1, wherein the polar solvent is one or more selected from the group consisting of water, acetonitrile, and tetrahydrofuran.

7. The method of claim 6, wherein under a condition that the polar solvent is water, the method further comprises adjusting a pH of the mixed liquor to 6.5 to 7.5.

* * * * *